US006945787B2

(12) United States Patent
Matsuo

(10) Patent No.: US 6,945,787 B2
(45) Date of Patent: Sep. 20, 2005

(54) ELECTRICAL CONNECTOR FOR CIRCUIT BOARD AND ELECTRICAL CONNECTOR ASSEMBLY HAVING THE SAME AND TRANSMISSION BOARD

(75) Inventor: Tsutomu Matsuo, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/768,109

(22) Filed: Feb. 2, 2004

(65) Prior Publication Data

US 2004/0192078 A1 Sep. 30, 2004

(30) Foreign Application Priority Data

Mar. 31, 2003 (JP) ..... 2003-095266

(51) Int. Cl.[7] ..... H01R 12/00
(52) U.S. Cl. ..... 439/65; 439/631
(58) Field of Search ..... 439/65, 631, 701, 439/83

(56) References Cited

U.S. PATENT DOCUMENTS 4,998,887 A * 3/1991 Kaufman et al. ..... 439/701
6,162,068 A * 12/2000 Wu ..... 439/79
6,171,153 B1 * 1/2001 Belopolsky ..... 439/701
6,435,897 B1 * 8/2002 Paul et al. ..... 439/701
6,508,676 B1 * 1/2003 Xu ..... 439/701

FOREIGN PATENT DOCUMENTS

JP 2001-160436 6/2001

* cited by examiner

*Primary Examiner*—Tho D. Ta
(74) *Attorney, Agent, or Firm*—Takeuchi & Kubotera, LLP

(57) ABSTRACT

An electrical connector (10) for a circuit board (P1) includes a fixing member (20) having a first housing (21) with a mount face facing to the circuit board and at least one fixing piece (25) for fixing the first housing to the circuit board, and a connection member (30) having a second housing (32) with a mount face facing to the circuit board and a plurality of terminals (33) connected with circuit traces of the circuit board. The connection member is supported by the fixing member by a bottle neck such that the second housing is spaced from the first housing.

13 Claims, 10 Drawing Sheets

ELECTRICAL CONNECTOR FOR CIRCUIT BOARD AND ELECTRICAL CONNECTOR ASSEMBLY HAVING THE SAME AND TRANSMISSION BOARD

BACKGROUND OF THE INVENTION

1. Field of the Invention

This invention relates to an electrical connector for a circuit board and a connector assembly including the electrical connector, a transmission board connected to the electrical connector, and another connector connected to the transmission board.

2. Description of the Related Art

A conventional electrical connector for a circuit board disclosed in Japanese Patent Application Kokai Number 2001-160436 comprises pin-type terminals which are provided in a housing and have first connection sections in a cavity of the housing and second connection sections projecting from the lower side of the housing for soldering by solder balls.

The conventional connector is disposed at a corresponding position of the circuit board and fixed by a supporter provided in the housing and the second connection sections of the terminals are connected to corresponding circuit trances by melting the soldering balls by application of hot air.

The connector disclosed in the above patent application is firmly fixed to the circuit board by the supporter of the housing. The second connection sections of the terminals are very short and rigid so that they are not displaceable after fixed by the soldering-connection.

However, in this kind of connector, stress caused by an external force or temperature change is directly transmitted to the second connection sections and causes a crack at the soldered position, resulting in a disconnection problem. This is because the connection sections is too rigid to ease the stress.

BRIEF SUMMARY OF THE INVENTION

Accordingly, it is an object of this invention to provide an electrical connector for a circuit board capable of preventing the transmission of stress caused by external force to a connection section thereof, being easily soldered without soldering defective, and improving electrical characteristics.

According to the invention, an electrical connector comprises a housing having a plurality of terminals connected to circuit traces of a circuit board and at least one fixing piece for fixing the connector to the circuit board. Also, the invention includes a connector assembly comprising the electrical connector and a transmission board connected to the connector.

(First Embodiment)

According to an aspect of the invention, an electrical connector for a circuit board comprises a fixing member having a first housing with a mount face facing to the circuit board and at least one fixing piece for fixing the first housing to the circuit board, and a connection member having a second housing with a mount face facing to the circuit board and a plurality of terminals connected to circuit traces of the circuit board. The connection member is supported by the fixing member with a bottle neck.

In this structure, even if the fixing member receives an external force after the connector is connected to the circuit board, since the bottle neck has large resistance against the transmission of stress, only limited stress is transmitted to the connection member. That is, the stress applied to the terminals provided in the connection member is lightened to large extent. Although most stress is applied to the fixing member, the fixing piece is sufficiently strong to support the fixing member, causing no problem. Namely, the stress is distributed to the fixing and connection members appropriately.

Since the connector is composed of the fixing and connection members, it is possible to attach the fixing member to the circuit board after the connection member is connected to the circuit board by soldering. In case of a conventional connector having both the members in one body, large amount of heat for soldering may be radiated to whole part of the connector, causing delay in solidification of solder. In addition to that, since the connector has an unstable shape, it is possible that the positioning of the connector is deviated or the connector falls down before the solder becomes solid. However, according to the invention, even if whatever shape or size the fixing member has, the connection member may be stable and have small size.

The first housing has a plurality of slits opened upwardly for receiving transmission boards and the terminals have contact portions projecting into the slit for connection to the transmission board. Also, another connector can be connected through the transmission board.

The connection member has the bottle neck at part of the terminal or at part of the second housing to be supported by the first housing of the fixing member.

The terminals are provided in the second housing such that the terminals are arranged in the mount face of the second housing in rows and columns in a matrix form. The second housing is divided into a plurality of divisional housings in the rows or columns and the terminals are arranged in the respective divisional housings. The divisional connection members (divisional housings) are collectively supported by the fixing member.

It is preferable that the first housing has a guiding face to control the first housing to be spaced from the second housing at a predetermined distance. Since the fixing and connection members keep a constant space therebetween by the guiding face, the distance of the space maintained uniform at different positions and the contact of both the members is avoided.

It is preferable the first and second housings are detachably plugged in each other and have at least one key or key groove in a plugging face thereof, respectively. Although the housings are prone to be miss-plugged in each other because of space therebetween, the key and key groove prevent the plugging error.

In the connection member, the terminals are integrally formed with the second housing so that the second housing can hold the terminals firmly in a simple manner.

The fixing piece is made of a metal and has a lower end projecting downwardly from the mount face of the first housing and the terminals have connection portions projecting downwardly from the mount face of the second housing. The projecting portions of the lower end and connection portions are provided with soldering balls, respectively. The fixing piece and the connection portions of the terminals are easily fixed to the circuit board by applying hot air to the soldering balls on the circuit board. It is preferable that the lower end projects longer than the connection portions by a predetermined amount. It is because when the fixing and connection members descent toward the circuit board when the soldering balls are melted, the projecting portion of the fixing member abuts against the circuit board first to prevent contact pressure or abutting pressure from being applied to the connection portions of the terminals. Also, it is because even if the positions of the lower ends of the connection portions are deviated to some extent, the deviation of the positions can be absorbed within the predetermined amount.

It is preferable that the fixing piece has at least one shoulder which abuts against an engaging portion provided in the first housing to control the fixing piece to be inserted into the first housing to a predetermined position. That is, the shoulder controls the projection amount of the lower end of the fixing piece from the first housing to be a predetermined amount.

The terminals are composed of a plurality of pairs of pair terminals arranged in rows and columns in a matrix form, wherein each pair of the pair terminals is paired at a predetermined distance in the column and each terminal of the pair terminals comprises a support portion supported by the second housing, an resilient arm portion extending upwardly from the second housing toward a fixing member side, a contact portion provided at the top of the resilient arm portion, and a connection portion extending downwardly from the second housing. The pair terminals are composed of first type pair terminals and second type pair terminals, which are alternately disposed in the row direction. The connection portions of the first and second pair terminals are offset, respectively, with respect to the resilient arm portions in the opposite column directions by half of the predetermined distance.

The connection portions of the pair terminals are connected to corresponding pair lands of the circuit board (terminals of the circuit board). Wiring portions (lead portions) extend from the respective lands. The wiring portions for the pair lands extend between the pair lands. Since the respective lands are not spaced so much, the wiring portions extending from the lands for the adjacent other pair terminals can not be provided between the pair lands. Accordingly, the next layer of the circuit board is provided to form the wiring portions for the other pair lands. That means that areas between the pair lands are used for the wiring portions, however, areas between two pair lands are not used for the wiring portions. Accordingly, the number of layers is increased. According to the invention, the connection portions of the first and second type terminals are offset in opposite directions so that the areas between two pair lands are also used for the wiring portions, thereby reducing the number of layers.

The support portion is integrally formed with the second housing. In this case, it is preferable that the support portion is provided with a projection or dent for strengthening an engagement with the second housing.

(Second Embodiment)

According to another aspect of the invention, an electrical connector assembly comprises an electrical connector for a circuit board including a fixing member having a first housing with a mount face facing to the circuit board and at least one fixing piece for fixing the first housing to the circuit board and a plurality of slits provided in the first housing and opened upwardly, and a connection member having a second housing with a mount face facing to the circuit board and a plurality of terminals, wherein each terminal has a connection portion for connection with circuit traces of the circuit board and a contact portion projecting into the slit of the fixing member. The connection member is supported by the fixing member by a bottle neck. The connector assembly further comprises a plurality of transmission boards, wherein each transmission board has a first edge which is inserted into the slit of the fixing member of the electrical connector for contact with the contact portions of the terminals and a second edge perpendicular to the first edge, which is provided outside the electrical connector and has connection pads for connection with another electrical connector.

In this electrical connector assembly, another connector can be connected to the transmission board.

In the similar way as in the first embodiment, the terminals are provided in the second housing such that the terminals are arranged in the mount face of the second housing in rows and columns in a matrix form. The second housing is divided into a plurality of divisional housings in the rows or columns and the terminals are arranged in the respective divisional housings.

In the similar way as in the first embodiment, the fixing piece is made of a metal and has a lower end projecting downwardly from the mount face of the first housing and the terminals have connection portions projecting downwardly from the mount face of the second housing. The projecting portions of the lower end and connection portions are provided with soldering balls, respectively.

DESCRIPTION OF THE PREFERRED EMBODIMENT

Embodiments of the present invention will now be described with reference to the accompanying drawings.

Figure 1:
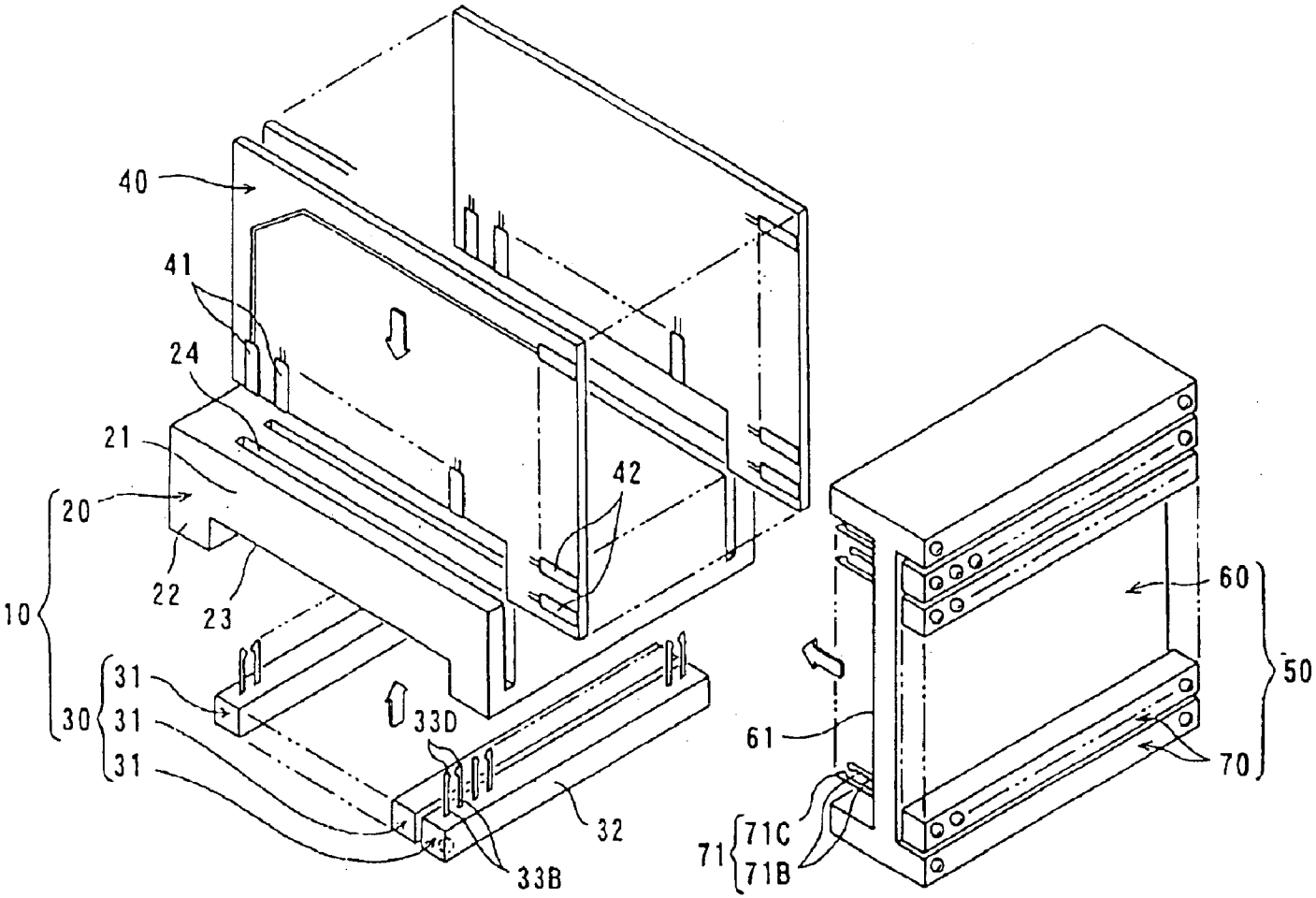
FIG. 1 is a perspective view of an electrical connector according to an embodiment of the present invention and a transmission board connected thereto, wherein the electrical connector and the transmission board are separated.
Figure 2:
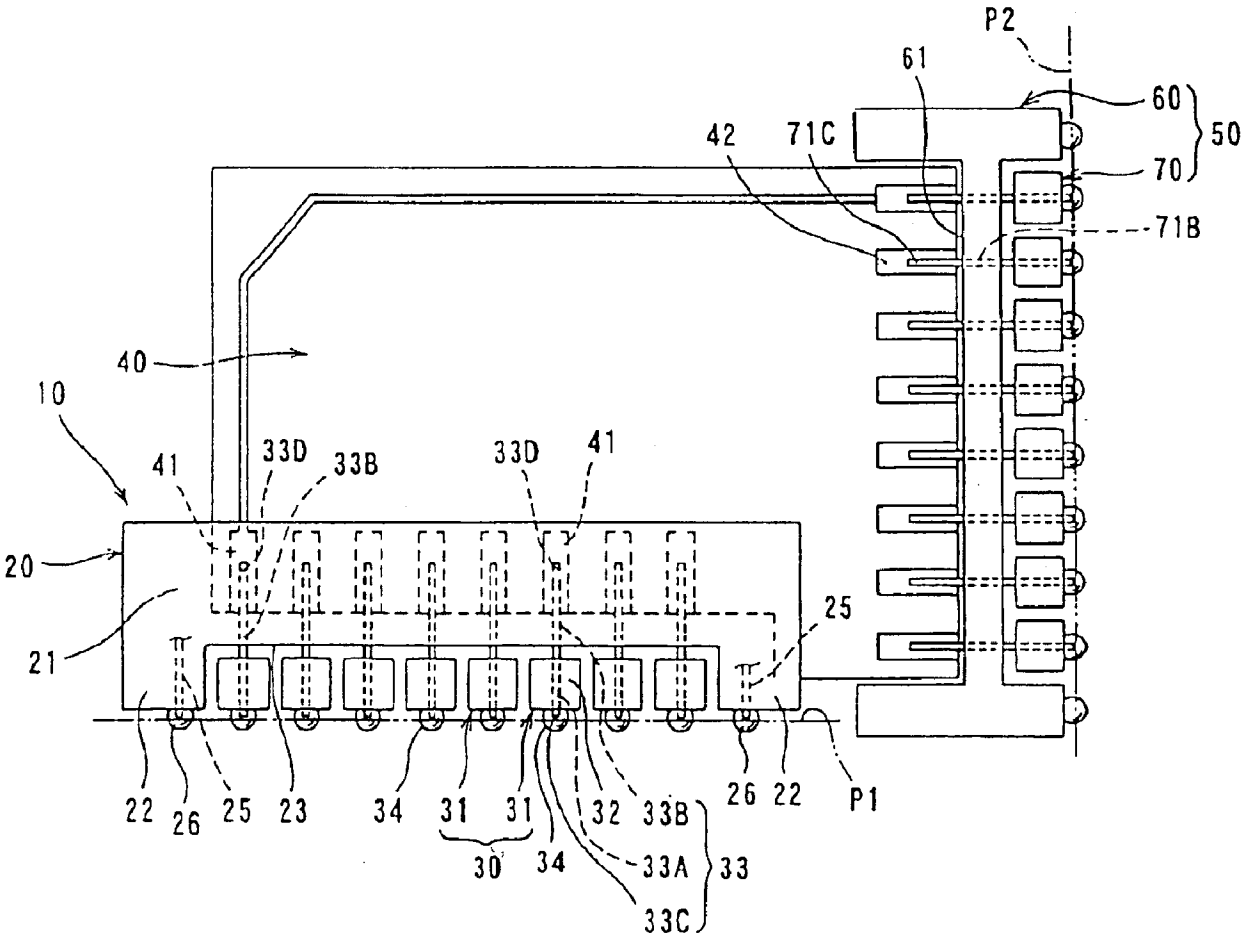
FIG. 2 is a front view of FIG. 1 showing that the connector and board are assembled.

In FIGS. 1 and 2, a connector 10, which is mounted on a circuit board P1, comprises a fixing member 20 and a plurality of connection members 30. A plurality of transmission boards 40 are connected to the connector 10 and another connector 50 is connected to the transmission boards 40. FIGS. 1 and 2 show conditions before and after the respective members are assembled for connection, respectively.

The fixing member 20 of the connector 10 has a first housing 21 which is made of an electrically insulating material. The first housing 21 is provided with a hollow 23 between legs 22 provided at lower sides thereof and a plurality of accommodation slits 24 provided in parallel and opened to an upper side and one of lateral sides thereof. The accommodation slits 24 extend downwardly up to the hollow 23. Fixing pieces 25, which are fine pieces or pins made by stamping a metal sheet, are press-fitted into or integrally formed with the legs 22 of first housing 21 so that they are held in the first housing 21. Lower portions of the fixing pieces 25 project from the lower side (side to be mounted on the circuit board P1) of the legs 22 and is provided with soldering balls 26.

The connection member 30 comprises a second housing made of an electrically insulating material and a plurality of terminals implanted in the second housing. In this embodiment, the connection member 30 is formed of a plurality of divisional connection members 31, each of which has a divisional housing 32 and terminals 33 implanted in the divisional housing 32. The terminals 33 of the respective divisional connection members 31 are composed of a plurality of pair terminals. Each terminal of the respective pair terminals 33 has a support portion 33A, at which the terminal 33 is supported by the second divisional housing 32 integrally formed therewith, a resilient arm portion 33B extending upwardly from the second housing 32, and a connection portion 33C extending downwardly from the second housing 32. A pair of the resilient arm portions 33B of the pair terminals 33 are provided with contact portions 33D at the tops thereof, which face each other. The connection portion 33C is provided with a soldering ball 34. The connection portion 33C is positioned upper than the lower end of the fixing pieces 25 projecting from the lower side of the leg 22 of the first housing 21. It is preferable that the supporting portion 33A of the terminal 33 is provided with a projection or dent for increasing the supporting force produced by the integral forming with the second housing 32.

When viewed from the top, a plurality of the divisional connection members 31 are arranged and accommodated in the hollow 23 such that the longitudinal direction of the divisional connection members is perpendicular to the accommodation slits 24 of the fixing member 20. The resilient arm portion 33B of the divisional connection member 31 is press-fitted from the lower side into and held in corresponding groove provided in the first housing 21, and the upper side of the resilient arm portion or the contact portion 33D is positioned inside the accommodation slit 24. Accordingly, when the below-mentioned transmission board 40 is inserted into the accommodation slit 24, a pair of the contact portions 33D of the pair terminals 33 are brought into resilient contact with corresponding connection pads provided on both sides of the transmission board 40 such that the contact portions 33D hold the corresponding pads therebetween. A plurality of the second housings 32 of the divisional connection members 31 are spaced from each other and accommodated in the hollow 23 of the fixing member 20 such that they are spaced from the first housing 21. Accordingly, the divisional connection member 31 is communicated with the fixing member 20 only through extremely narrow part, namely part of the resilient arm portion 33B of the terminal. That is, the fixing member 20 and the connection member 30 of the connector 10 are connected to each other through an extremely narrow bottle neck and have lots of spaces at the other parts therebetween. The lower faces of the legs 21 of the fixing member 20 are flush with the lower face of the connection member 30.

The transmission board 40 is made of an electrically insulating material and has transmission circuits on both sides thereof and distal ends of the transmission circuits or connection pads in circumferential region thereof. In the case shown in the figures, the transmission board 40 is substantially L-shaped, having a rectangular shape with a small projecting part. A plurality of connection pads 41 and 42 are provided at lower edge and right-hand edge of the transmission board 40, respectively. The thickness of the transmission board 40 and the positions of the connection pads 41 are determined such that corresponding contact portions 33D of the pair terminals 33 are brought into resilient contact with the connection pads 41. The connection pads 42 are arranged in the same way as in the connection pads 41 with respect to the below-mentioned connector 50. A plurality of the transmission boards 40 are inserted into the accommodation slits 24 of the fixing member 20 from the side of the connection pads 41 and connected to the pair terminals 33 of the connection member 30.

Another connector 50, which is connected to the transmission boards 40, has the similar structure as the connector 10, that is, has a fixing member 60 and a connection member 70. The connection member 70 is the completely same as the connection member 30 of the connector 10. However, the fixing member 60, which is fixed to a circuit board P2, is different from the fixing member 20 of the connector 10, that is, has no plurality of accommodation slits but one hollow 61. Accordingly, contact portions 71C and resilient arm portions 71B of pair terminals 71 of the connection member 70 project into the hollow 61. The contact portions 71C of the pair terminals 71 are brought into resilient contact with the connection pads 42 of the transmission board 40.

How to use the connector 10 according to the embodiment will be described.

(1) A plurality of the divisional connection members 31 are held by the fixing member 20 by press-fitting the resilient arm portions 33B of the terminal 33 into corresponding grooves of the fixing member 20 from the side of the hollow 23. The divisional connection members 31 are supported only by the resilient arm portions 33B and the second housings 32 of the connection member 30 are spaced from the first housing 21 of the fixing member 20 at a predetermined distance. Under this condition, the lower face of the legs 22 of the first housing 21 and the lower face of the second housing 32 are flush with each other and form a mounted face for mounting the connector 10 on the circuit board P1.

(2) Similarly, a plurality of the connection members 70 of another connector 50 are fixed to and held by the fixing member 60.

(3) Then, the connectors 10 and 50 are mounted at predetermined positions on the corresponding circuit boards P1 and P2, respectively, which are placed on the level. At this point, the soldering balls 26 provided at the lower ends of the fixing pieces 25 of the fixing member 20 of the connector 10 and the soldering balls 34 provided on the connection portions 33C of the terminals 33 of the connection member 30 are disposed on corresponding circuit traces on the circuit board P1. Similarly, soldering balls provided at the lower ends (right-hand side in FIGS. 1 and 2) of the fixing pieces of the connector 50 and soldering balls provided at the lower ends of the terminals of the connector 70 are disposed on corresponding circuit traces on the circuit board P2.

(4) Then, hot air is blown to the soldering balls 26 and 34 to melt them so that the fixing pieces 25 are fixed to the circuit board P1 and the terminals 33 are connected to the circuit board P1 when the melted solder is caked. As the soldering balls 26 and 34 are melted, the connector 10 descends until the lower ends of the fixing pieces 25 are brought into contact with the surface of the circuit board P1. Since the lower ends of the fixing pieces 25 extend longer than the lower ends of the connection portions 33C of the terminals 33, the lower ends of the fixing pieces 25 act as a stopper for preventing the terminals 33 from strongly abutting against the circuit board P1 when used afterward. Actually, the lower ends of the fixing pieces 25 and the terminals 33 do not extend so much as shown in the figures. Accordingly, the connector 10 is connected to the circuit traces of the circuit board P1 in the state that the lower surfaces of the first and second housings 21 and 22 are substantially touched with the circuit board P1. The connector 50 is subject to the similar soldering-connection with respect to the circuit board P2.

(5) The connection pads 41 of the transmission board 40 are inserted into the accommodation slits 24 of the connector 10, which has been mounted on and connected to the circuit board P1. The contact portions 33D of the terminals 33 of the connector 10 are brought into resilient contact with the connection pads 41 for electrical connection.

(6) The connector 50, which has been fixed to and connected to the circuit board P2, is connected to the other connection pads 42 of the transmission board 40. The contact portions 71C of the terminals are brought into resilient contact with the connection pads 42 for electrical connection.

(7) As described above, the circuit boards P1 and P2 are electrically connected to the connectors 10 and 50 through the transmission board 40.

(8) For connecting the connectors 10 and 50 to the circuit boards P1 and P2, it is possible that the connection members 30 and 70 are connected to the circuit boards P1 and P2 first, then, the terminals of the connection members 30 and 70 are fixed to the connectors 10 and 50 while holding the terminals by the fixing members 20 and 60.

Figure 3:
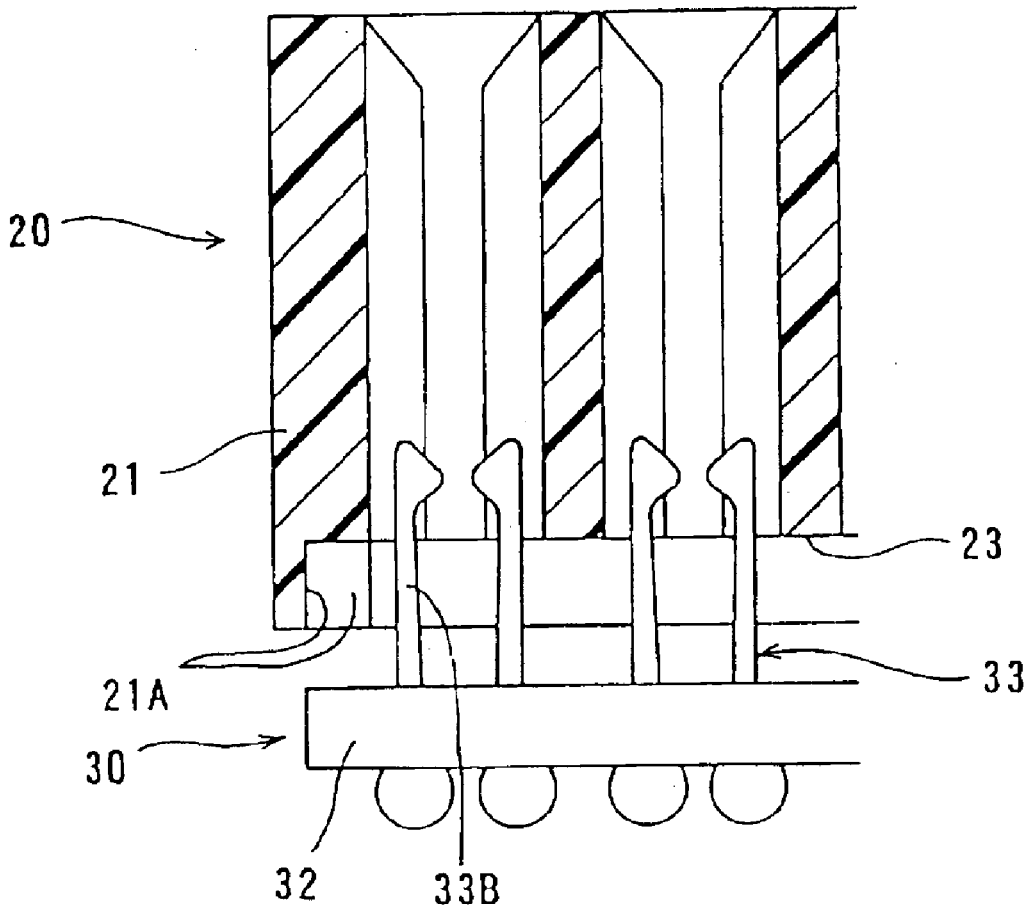
FIG. 3 is a sectional view of a variation of the electrical connector according to the present invention, wherein a fixing member has a guide face for a connection member.

This embodiment can be partially modified. For example, in FIG. 3, at least one guide face 21A is provided on the first housing 21 so that the second housing 32 of the connection member 30 and the first housing 21 of the fixing member 20 are spaced from each other by a predetermined distance when the connection member 30 is held by the first housing 21 of the fixing member 20. The guide face 21A is provided in the hollow 23 of the first housing 21 for guiding an edge (including an edge face and side faces in the vicinity of the edge face) of the second housing 32 to define the position of the second housing 32 so that most part of the second housing 32 except for the edge is spaced from the hollow 23 of the first housing 21 at a predetermined distance. In this example, since the resilient arm portions 33B of the terminals 33 are not press-fitted into the first housing 21, only the edge of the connection member 30 is held by the guide face 21A. Thus, part of the connection member 30, which is in contact with the guide face 21*a*, is extremely small so that the part in contact form a bottle neck.

Figure 4:
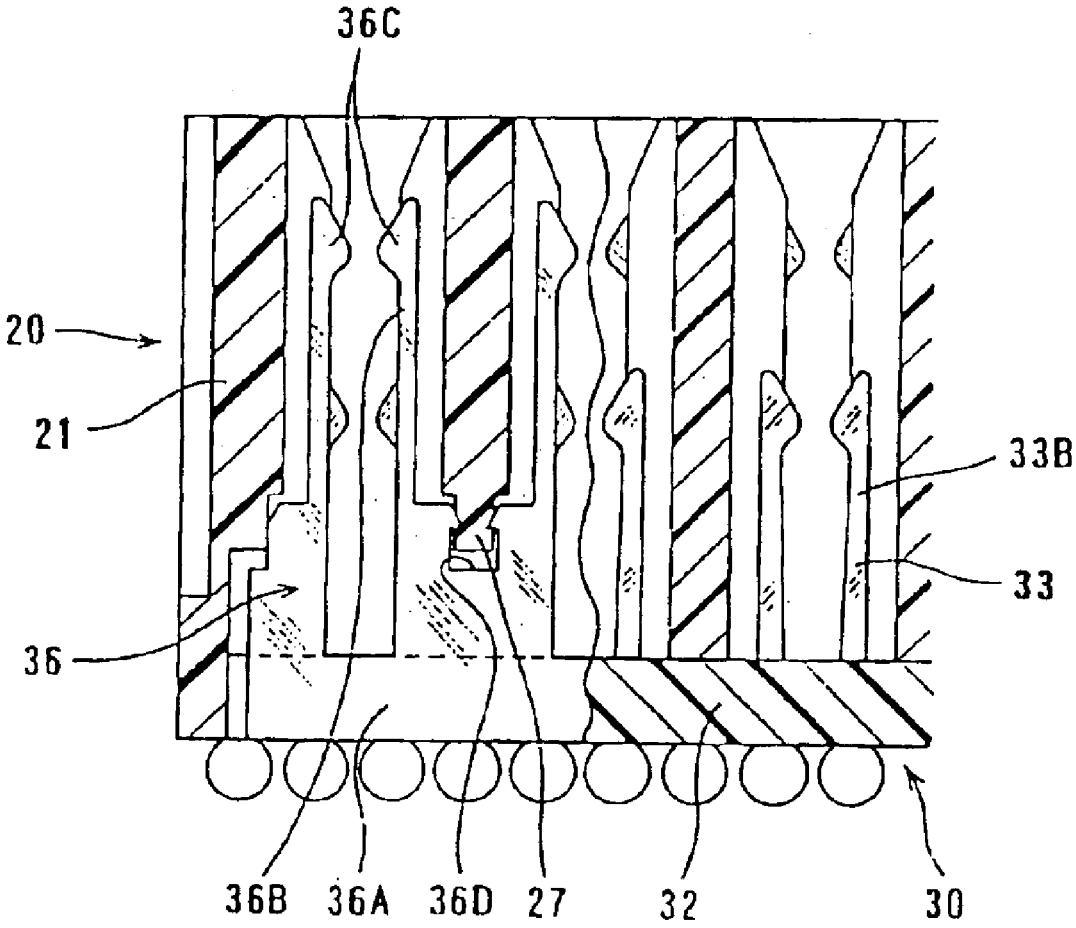
FIG. 4 is a sectional view of another variation of the electrical connector according to the present invention, wherein the connection member is held by the fixing member with ground terminals.

In FIG. 4, the connection member 30 has a ground terminal 36 as well as the signal pair terminals 33 and is held by the first housing 21 of the fixing member 20 by means of the ground terminal 36. That is, the connection member 30 of the second housing 32 has a plurality of the similar signal terminals 33 as shown in FIG. 1 and one ground terminal 36 attached to the side of the second housing 32. The ground terminal 36 is made by stamping and processing a metal sheet and comprises a base portion 36A and a plurality of pairs of resilient arm portions 36B extending upwardly from the base portion 36A at positions corresponding to the resilient arm portions 33B of the signal pair terminals 33 provided in the longitudinal direction of the second housing 32. The resilient arm portions 36B of the ground terminal 36 are longer than the resilient arm portions 33B of the signal terminals 33 and comprises contact portions 36C at the tops thereof. A fitting groove 36D is provided between the adjacent paired resilient arm portions 36B of the ground terminal 36 so that a corresponding support portion 27 of the first housing 21 is press-fitted in the fitting groove 36D for holding the first housing 21. In this case, the first housing 21 may be spaced from the second housing 32 or as shown in FIG. 4, the first housing 21 may abut against the second housing 32 such that the second housing 32 is slidable on the lower surface of the hollow 23 of the first housing 21. Since the thickness of the ground terminal 36 is extremely small compared with the dimension of the connection member 30, part of the ground terminal 36, which is held by the first housing 21, forms a bottle neck.

Figure 5:
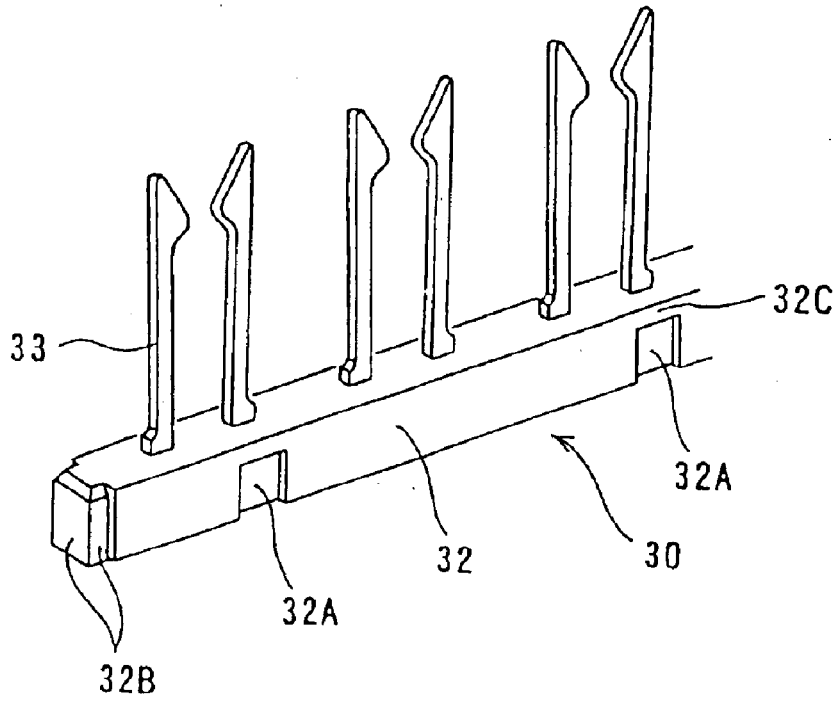
FIG. 5 is a perspective view of still another variation of the electrical connector according to the present invention, wherein the connection member has key grooves for preventing plugging error.

In FIG. 5, key grooves 32A for preventing plugging error are provided in the second housing 32 of the connection member 30. The key grooves 32A are provided at positions, which are different from the positions of the key grooves of another connector or another connection member, so as to engage keys (not shown) provided in the first housing or the adjacent connection member. Thus, a plugging error with another connector or another connection member is prevented. If the key grooves 32A are provided at asymmetric positions, the second housing 32 itself is prevented from being plugged in a miss-oriented direction. In this example, the second housing 32 is in contact with the first housing 21 at the key grooves 32A and guided faces 32B provided at ends thereof. That is, both the housings are slidably attached to each other by bottle necks. If the guided faces 32B are made asymmetric, the plugging error between the first and second housings 21 and 32 is prevented.

In FIG. 5, banks 32C are provided above the key grooves 32A. An adjacent connection member (not shown) is provided with keys which are engaged with the key grooves 32A and inserted into the connection member 30 from the lower side until the keys abut against and stopped at the key grooves 32A. In this way, a plurality of connection members are assembled. When disassembled, the connection members are removed in the reverse order.

Figure 6:
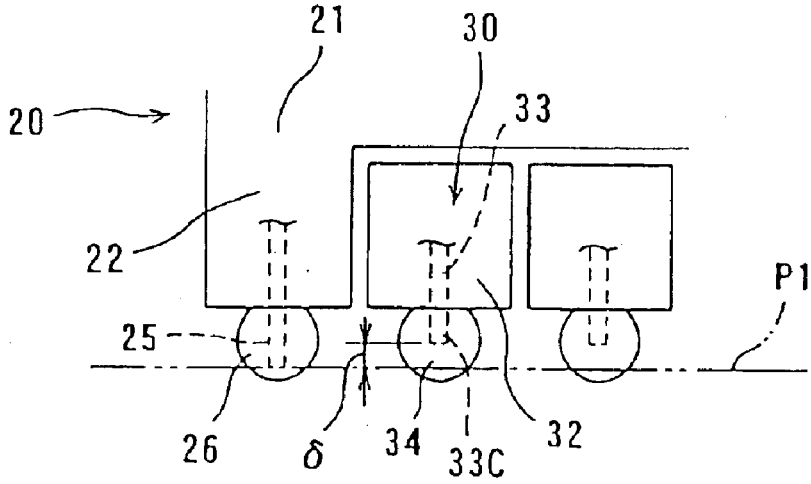
FIG. 6 is an illustration of yet another variation of the electrical connector according to the present invention, wherein fixing piece has a stopper for controlling the decent amount of the connector upon the melting of soldering balls.

In FIG. 6, a stopper is shown which is used when the terminals 33 of the connection member 30 are connected to the circuit board P1 by the soldering balls 34. As mentioned above with respect to FIGS. 1 and 2, the lower portions of the fixing pieces 25 which projects from the lower faces of the legs 22 of the first housing 21 of the fixing member 20 are longer than, by the amount of δ, the lower portions of the terminals 33 (the lower portions of the connection portions 33C) which projects from the lower face of the second housing 32 of the connection member 30. Accordingly, when the connector descends by its own weight while the soldering balls 26 and 34 are melted upon the soldering connection, the lower end of the fixing pieces 25 abut against the surface of the circuit board P1 so that the connection portions 33C of the terminals 33 are stopped before abutting against the circuit board P1 with a small space between the connection portions 33C and the circuit board P1. Consequently, even if there is some deviation in the amount of the projection of the connection portions 33C from the lower face of the second housing 32 among a plurality of the connection portions 33C, the deviation is absorbed in the amount of δ.

Figure 7:
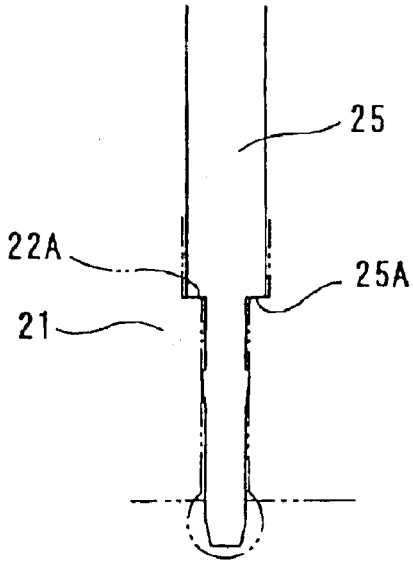
FIG. 7 is an illustration of another variation of the electrical connector according to the present invention, wherein the fixing piece has a shoulder for determining the position thereof.

In FIG. 7, the fixing pieces 25 are provided with shoulders for securely setting the amount of the projection of the lower portions of the fixing pieces 25 within a predetermined amount. That is, in FIG. 7, the fixing piece 25 comprises the shoulder 25A so that when the fixing pieces 25 is press-fitted into the corresponding groove of the first housing 21 from upper side, the shoulder 25A engages an engaging step 22A of the first housing 21 to control the depth of the press-fit and make the projection from the first housing 21 within the predetermined amount. Also, when the connectors 10 and 50 are plugged in each other, the shoulder 25A prevents an upward drop-off of the first housing 21 from the fixing piece 25 which may be caused by an impact produced by the plug-in.

Figure 8:
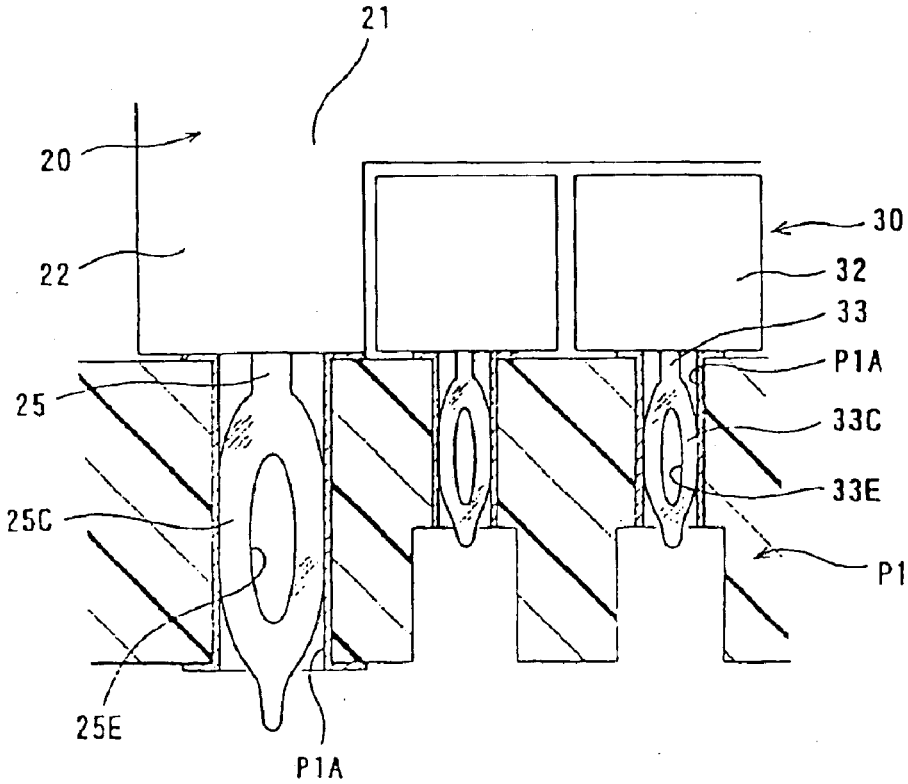
FIG. 8 is an illustration of still another variation of the electrical connector according to the present invention, wherein lower portions of terminals and the fixing piece are press-fitted into a circuit board
Figure 9:
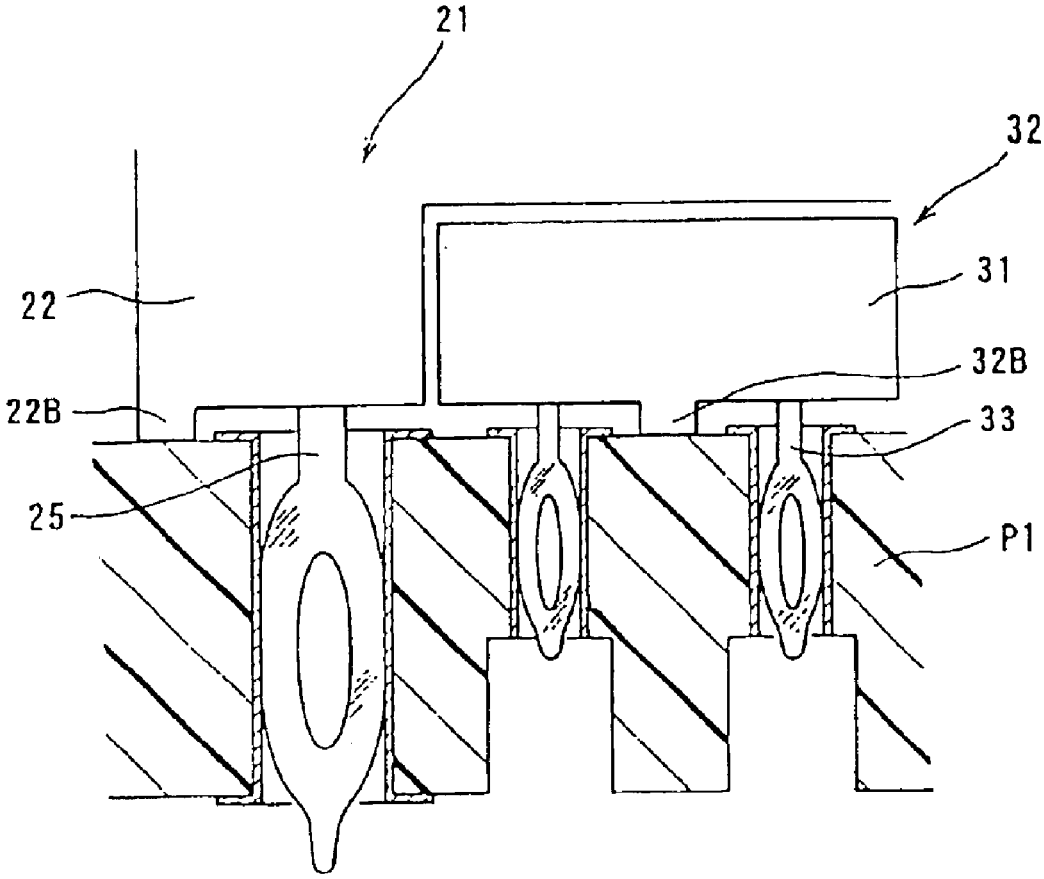
FIG. 9 is a variation of FIG. 8 showing stoppers of the fixing and connection members.

FIGS. 8 and 9 show variations of the lower portion of the fixing piece 25 of the fixing member 20 and the terminal 33 of the connection member 30, respectively. In FIGS. 1 and 2, the soldering balls are used for fixing and connecting the lower portions to the circuit board. However, in FIG. 8, the lower portion is press-fitted into the circuit board P1. The lower portion of the fixing piece 25 fixed to the first housing 31 is provided with a press-fitted portion 25C, and the connection portions 33C of the terminals 33 implanted in the second housing 32 function as press-fitted portions. The press-fitted portion 25C is made larger than the press-fitted portions of the terminals 33 because it requires a greater strength, however, both of them have the same basic structure and are press-fitted from upper side into and fixed to corresponding holes of the circuit board. Holes 25E and 33E made by stamping are formed in the center of the press-fit portions of the fixing piece and terminals, respectively, to provide a resilient deformation upon the press-fit. Conductive layers P1A are provided inside the corresponding holes of the circuit board for electrical conduction between the terminals and the circuit traces. Also, the conductive layer P1A for the fixing piece 25 increases the strength of the surface and provides electrical conduction between the fixing piece 25 and shield circuit when the fixing piece 25 requires shielding.

In FIG. 9, in addition to the variation described above with respect to FIG. 8, stopper are provided to control the depth of the press-fit of the fixing piece 25 and the terminals 33 into the circuit board. That is, a stopper 22B projects from the lower surface of the leg 22 of the first housing 21 and a stopper 32B projects from the lower surface of the second housing 32 to control the depth of the press-fit of the fixing piece 25 and the terminals into the circuit board. In FIG. 8, two divisional connection members 31 are shown, however, in FIG. 9, the two divisional connection members 31 are integrated into one connection member 31 to provide the stopper 32B in the center of the connection member 31. Here, the shape of the fixing piece is not limited to the embodiments and may be made like a gull-wing or pin-in-paste structure.

Figure 10:
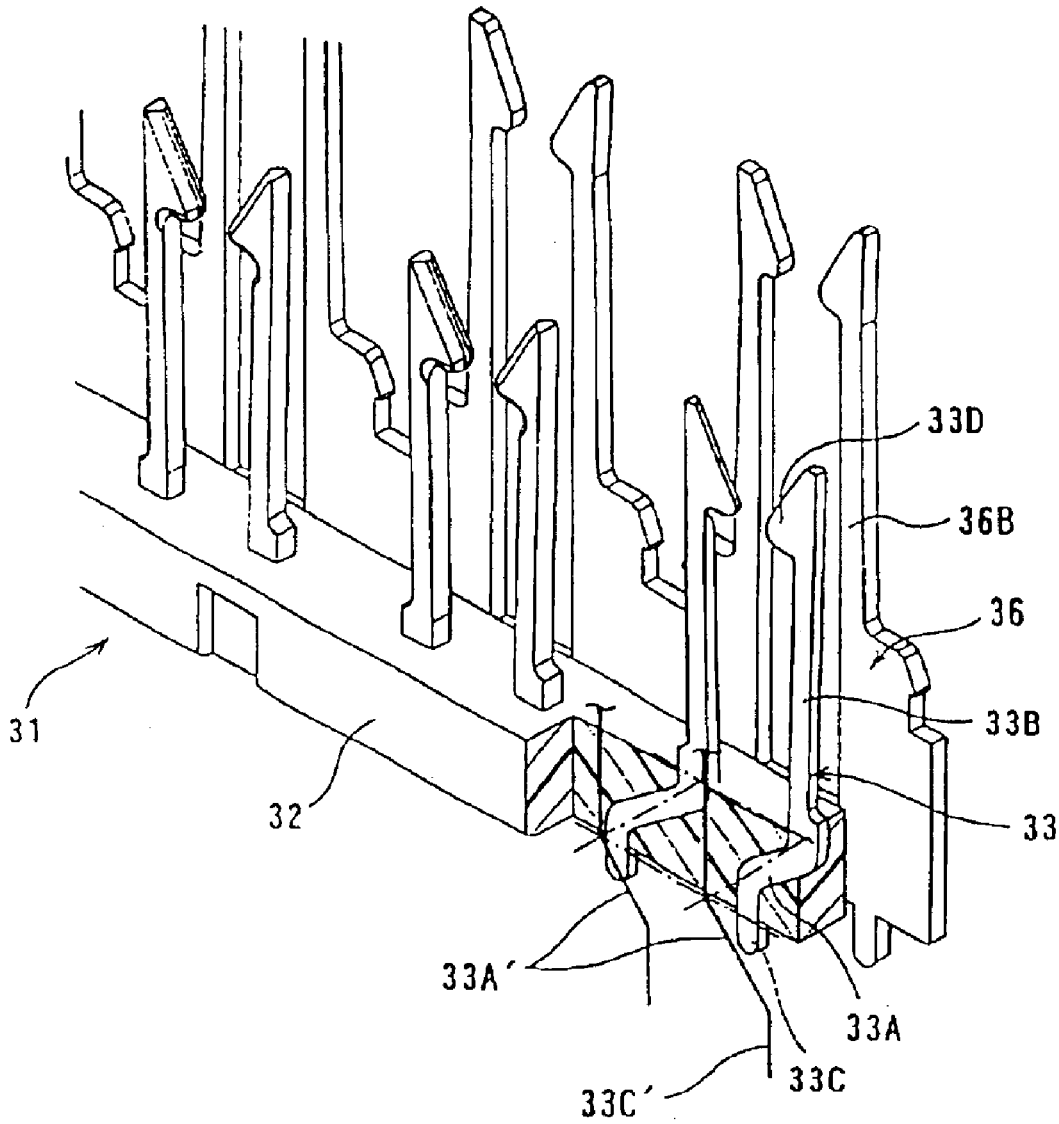
FIG. 10 is a perspective view, partially in section, of a connection member according to another embodiment of the present invention.
Figure 11:
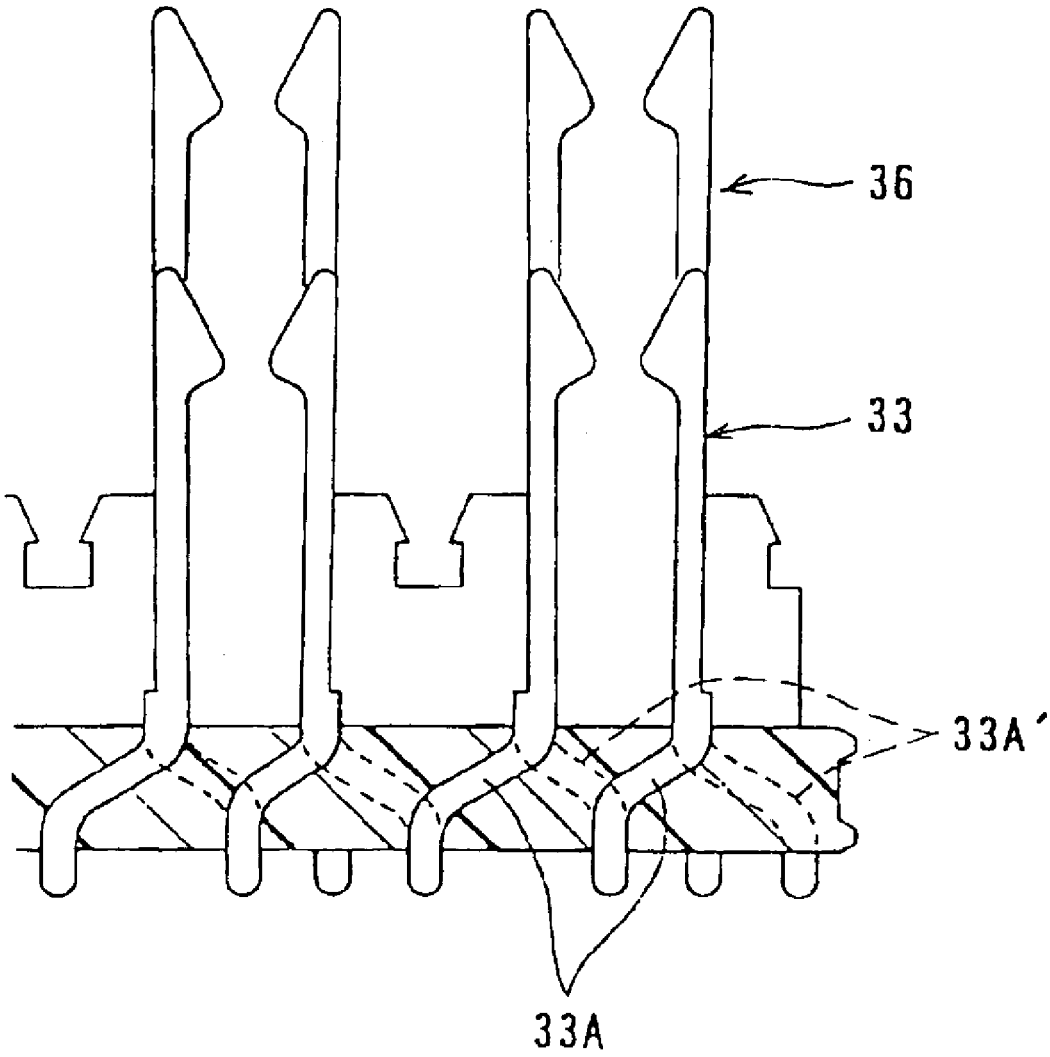
FIG. 11 is a sectional view of the connection section of FIG. 10.

In the embodiment shown in FIGS. 10 and 11, each divisional connection member 31 comprises a plurality of signal pair terminals 33 and one ground terminal 36. The connection portions 33C of the signal pair terminals 33 are offset by a half pitch in a direction of arrangement of the pair terminals 33 with respect to the reference position of the resilient arm portion 33B with the contact portion 33D. This offset is obtained by bending the support portions 33A of the pair terminals 33, which are supported by the integral forming with the second housing 32, in a shape of substantially crank. The ground terminal 36 is made, alike the ground terminal shown in FIG. 4, of a ground sheet attached to the side face of the second housing 32 and comprises resilient arm portions 36B at positions corresponding to those of the resilient arm portions 33B of the signal pair terminals 33. The resilient arm portions 36B of the ground terminal 36 is longer than the resilient arm portions 33B of the pair terminals 33.

Another (second) divisional connection member 31 (not shown) is arranged near the (first) divisional connection member 31 side by side. The support portions 33A'of the pair terminals of the second divisional connection member 31 are bent in a direction opposite to that of the pair terminals 33 of the first divisional connection member 31, as shown by a thick real line in FIG. 10 and by a dotted line in FIG. 11. The two kinds of the divisional connection members 31 are alternately arranged and connected to the circuit board shown in FIG. 12, respectively. Since the connection portions of the pair terminals of the two kinds of the divisional connection members 31 are offset by a half pitch in opposite directions, respectively, with respect to the reference position of the resilient arm portions 33B, the connection portions 33C of the two divisional connection members 31 are offset by one pitch when the contact portions 33D of the two kinds of divisional connection members 31 are aligned at the same position.

Figure 12:
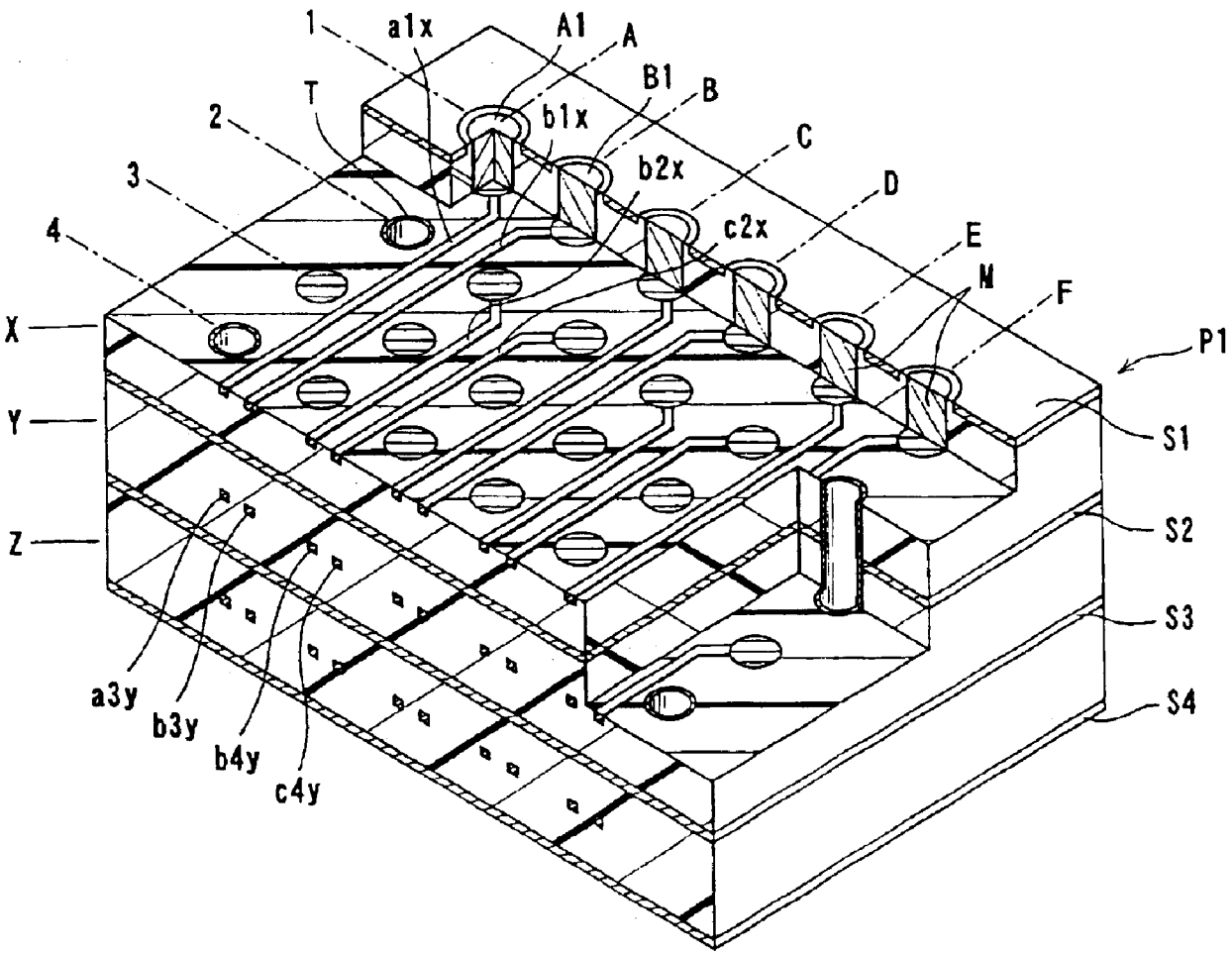
FIG. 12 is a perspective view, partially in section, of a circuit board connected to the connection member shown in FIGS. 10 and 11.

In FIG. 12, reference characters A, B, C, D, E, and F are affixed in the first direction on a plane of the circuit board P1 at an interval and reference numerals 1, 2, 3, and 4 are affixed in the second direction perpendicular to the first direction at an interval so that a specific position on the plane of the circuit board P1 is defined by the combination of the reference characters and numerals. For example, A1 is positioned at the upper left corner in FIG. 12. Reference characters X, Y, and Z are affixed in the third direction (in the direction of the thickness of the circuit board P1) perpendicular to the plane to indicate respective layers.

The circuit board P1 comprises layers X, Y, and Z and shield layers S1–S4 on the top and bottom of the circuit board and between the layers X, Y, and Z. First cylindrical conductive portions M are provided at the respective positions indicated by the combinations of the reference characters and numerals A–F and 1–4 except for A2, A4, F2, and F4. The first cylindrical conductive portions M extend through the circuit board P1 vertically, however, are spaced from the shield layers S1–S4. Accordingly, it is not conductive between the first cylindrical conductive portions M and the shield layers S1–S4. By contrast, second cylindrical conductive portions T are provided at the positions A2, A4, F2, and F4 and extend through the circuit board P1 vertically without any space to provide conduction between the second cylindrical conductive portions T and the shield layers S1–S4.

For example, the first divisional connection member 31 shown in FIG. 10 is connected to the conductive portions M at the positions A1–F1. That is, the connection portions 33C of the first pair terminals of the connection member 30 are connected to the conductive portions M at the positions A1 and B1, and the connection portions 33C of the second pair terminals are connected to the conductive portions M at the positions C1 and D1. Another connection member 30 has the second divisional connection members 31, of which connection portions 33C' of the pair terminals are bent in the opposite direction. Accordingly, the connection portions 33C' of another connection member 30 are offset from the connection portions 33C of the connection member 30 by one pitch. Consequently, the connection portions 33C' of the first pair terminals of another connection member are connected to the conductive portions M at the positions B2 and C2. The connection portions 33C' of the second pair terminals are connected to the conductive portions M at the positions D2 and E2. Thus, the connection member 30 is connected to the conductive portions M at the positions A1–F1 and A3–F3, and another connection member 30 is connected to the conductive members at the positions B2–E2 and B4–E4. The positions A2, F2, A4, and F4 are not used for the pair terminals but for ground terminals.

The wiring portions (lead portions) on the circuit board for the pair terminals are provided between the pair terminals. That is, the wiring portions $a1_x$ and $b1_x$ for the pair terminals of the first connection member 30, which are connected to the positions A1 and B1, extend between the positions A and B in the layer X, and the wiring portions $a3_x$ and $b3_x$ connected to the positions A3 and B3 extend between the positions A and B in the layer Y. Similarly, the wiring portions $b2_x$ and $c2_x$ of another (second) connection member 30 connected to the positions B2 and C2 extend between the positions B and C in the layer X, and the wiring portions $b4_x$ and $c4_x$ connected to the positions B4 and C4 extend between the positions B and C in the layer Y.

In this way, according to this embodiment, a pair of the wiring portions for the respective pair terminals are effectively arranged in each layer using all regions between the positions A–F.

If the connection portions of the pair terminals of two adjacent connections members are not offset to each other in the opposite directions and extend in the straight line of the resilient arm portions, the wiring portions are arranged between the positions A and B but can not be arranged between B and C. Consequently, twice number of the layers is required to provide all wiring.

As described above, the connector according to the present invention reduces by half the number of the layers of the circuit board. Since the difference in the transmission distances between the upper and lower layers is becomes small by reducing the number of the layers, and since the difference in open ends (stubs) caused by the distribution of the conductive portions M between the upper and lower layers becomes small by reducing the number of layers, the electrical characteristics are improved especially in high-speed transmission.

As fully described, according to the present invention, the housing of the connector is divided into the first housing of the fixing member having fixing pieces and the second housing of the connection member in which the terminals are implanted, and both the housings are connected to each other by the bottle neck of the connection member, even if the fixing member receives external force, the transmission of stress is reduced by the bottle neck so that the stress applied to the connection member is reduced extremely. Consequently, the connection between the connection member and the circuit board is maintained excellent over long term usage. Also, when the connector is connected to the circuit board, only the connection member is connected to the circuit by soldering in advance, thus preventing problems caused by the integrated unstable shape and large amount of heat of the conventional connector.

What is claimed is:

1. An electrical connector for a circuit board, comprising:

a fixing member having a first housing with a mount face facing to said circuit board and at least one fixing means for fixing said first housing to said circuit board; and a connection member having a second housing with a mount face facing to said circuit board and a plurality of terminals connected to circuit traces of said circuit board, said connection member being supported by said fixing member with a bottle neck of said connection member, wherein said first housing has a plurality of slits opened upwardly for receiving transmission boards and said terminals have contact portions projecting into said slit for connection to said transmission board.

2. An electrical connector for a circuit board, comprising:

a fixing member having a first housing with a mount face facing to said circuit board and at least one fixing means for fixing said first housing to said circuit board; and a connection member having a second housing with a mount face facing to said circuit board and a plurality of terminals connected to circuit traces of said circuit board, said connection member being supported by said fixing member with a bottle neck of said connection member, wherein said connection member has said bottle neck at part of each of said terminals to be supported by said first housing of said fixing member.

3. An electrical connector for a circuit board, comprising:

a fixing member having a first housing with a mount face facing to said circuit board and at least one fixing means for fixing said first housing to said circuit board; and a connection member having a second housing with a mount face facing to said circuit board and a plurality of terminals connected to circuit traces of said circuit board, wherein said first housing has a guiding face to control said first housing to be spaced from said second housing at a predetermined distance;

wherein said first housing has a plurality of slits opened upwardly for receiving transmission boards and said terminals have contact portions projecting into said slit for connection to said transmission board.

4. An electrical connector, comprising:

a fixing member having a first housing with a mount face facing to said circuit board and at least one fixing means for fixing said first housing to said circuit board; and a connection member having a second housing with a mount face facing to said circuit board and a plurality of terminals having a connection portion fixedly connected to circuit traces of said circuit board, wherein said connection member is supported by said fixing member with a bottle neck of said connection member, said fixing means is made of a metal and having a lower end projecting downwardly from said mount face of said first housing, said terminals have connection portions projecting downwardly from said mount face of said second housing, and projecting portions of said lower end and connection portions are provided with soldering balls, respectively.

5. The electrical connector according to claim 4, wherein said lower end projects longer than said connection portions by a predetermined amount.

6. The electrical connector according to claim 5, wherein said fixing means has at least one shoulder which abuts against an engaging portion provided in said first housing to control said fixing means to be inserted into said first housing to a predetermined position.

7. An electrical connector, comprising:

a fixing member having a first housing with a mount face facing to said circuit board and at least one fixing means for fixing said first housing to said circuit board; and a connection member having a second housing with a mount face facing to said circuit board and a plurality of terminals having a connection portion fixedly connected to circuit traces of said circuit board, wherein said connection member is supported by said fixing member with a bottle neck of said connection member, said terminals are composed of a plurality pairs of pair terminals arranged in rows and columns in a matrix form, each pair of said pair terminals being paired at a predetermined distance in said columns and each terminal of said pair terminals having a support portion supported by said second housing, an resilient arm portion extending upwardly from said second housing toward a fixing member side, a contact portion provided at a top of said resilient arm portion, and a connection portion extending downwardly from said second housing, said pair terminals are composed of first type pair terminals and second type pair terminals, which are alternately disposed in a row direction, and said connection portions of said first and second pair terminals are offset, respectively, with respect to said resilient arm portions in opposite column directions by half of said predetermined distance.

8. The electrical connector according to claim 7, wherein said support portion is integrally formed with said second housing.

9. The electrical connector according to claim 8, wherein said support portion is provided with a projection or dent for strengthening an engagement with said second housing.

10. An electrical connector assembly comprising:

an electrical connector for a circuit board, including a fixing member having a first housing with a mount face facing to said circuit board and at least one fixing means for fixing said first housing to said circuit board and a plurality of slits provided in said first housing and opened upwardly, and a connection member having a second housing with a mount face facing to said circuit board and a plurality of terminals, each having a connection portion for connection with circuit traces of said circuit board and a contact portion projecting into said slit of said fixing member, wherein said connection member is supported by said fixing member by a bottle neck; and a plurality of transmission boards, each having a first edge inserted into said slit of said fixing member of electrical connector for contact with said contact portion of said terminal and a second edge outside said electrical connector perpendicular to said first edge and having connection pads for connecting with another electrical connector.

11. The electrical connector assembly according to claim 10, wherein said fixing means is made of a metal and having a lower end projecting downwardly from said mount face of said first housing and said terminals have connection portions projecting downwardly from said mount face of said second housing, wherein projecting portions of said lower end and connection portions are provided with soldering balls, respectively.

12. The electrical connector assembly according to claim 10, wherein said terminals are provided in said second housing such that positions of said terminals in said mount face of said second housing make rows and columns in a matrix form.

13. The electrical connector assembly according to claim 12, wherein said second housing is divided into a plurality of divisional housings in said rows or columns and said terminals are arranged in said respective divisional housings.

* * * * *